United States Patent [19]

May

[11] Patent Number: 4,724,775

[45] Date of Patent: Feb. 16, 1988

[54] METHOD AND APPARATUS FOR CONTROLLING THE RATE OF HEAT RELEASE

[75] Inventor: Michael G. May, Bel Air, Switzerland

[73] Assignee: AIR (Anti Pollution Industrial Research) Ltd., Arlington, Va.

[21] Appl. No.: 901,348

[22] Filed: Aug. 28, 1986

[51] Int. Cl.[4] ..... F23N 5/18

[52] U.S. Cl. ..... 110/186; 110/190; 110/341; 110/204; 236/14; 431/115

[58] Field of Search ..... 110/186, 190, 341, 204; 236/14, 15 E; 431/115, 116

[56] References Cited

U.S. PATENT DOCUMENTS

| | | | |
|---|---|---|---|
| 3,877,636 | 4/1975 | Sato | 236/14 |
| 4,187,542 | 2/1980 | Ball et al. | 431/12 X |
| 4,235,171 | 11/1980 | Leonard | 236/15 E |
| 4,286,548 | 9/1981 | Brash | 110/204 X |
| 4,309,949 | 1/1982 | Rastogi | 236/15 E X |
| 4,330,261 | 5/1982 | Sun | 236/15 E X |
| 4,499,857 | 2/1985 | Wormser | 236/14 X |
| 4,547,150 | 10/1985 | Vereecke | 431/75 X |
| 4,574,746 | 3/1986 | Keyes, IV et al. | 236/14 X |

*Primary Examiner*—Edward G. Favors
*Attorney, Agent, or Firm*—Edwin E. Greigg

[57] ABSTRACT

The subject invention relates to an improved method and apparatus to control the rate of heat release (ROHR) from a reaction zone confined within a chamber, air and fuel having been introduced into said reaction zone to achieve combustion, plural sensors being utilized one sensor adapted to sense ROHR, another to generate a target value for a desired ROHR within a comparator, still another sensor to determine heat generation and transmit it to the comparator, a control means for controlling ROHR of heat generation and connecting said comparator with said control means to achieve coincidence between a target value and said sensed value.

6 Claims, 1 Drawing Figure

METHOD AND APPARATUS FOR CONTROLLING THE RATE OF HEAT RELEASE

BACKGROUND OF THE INVENTION

Figure 1:
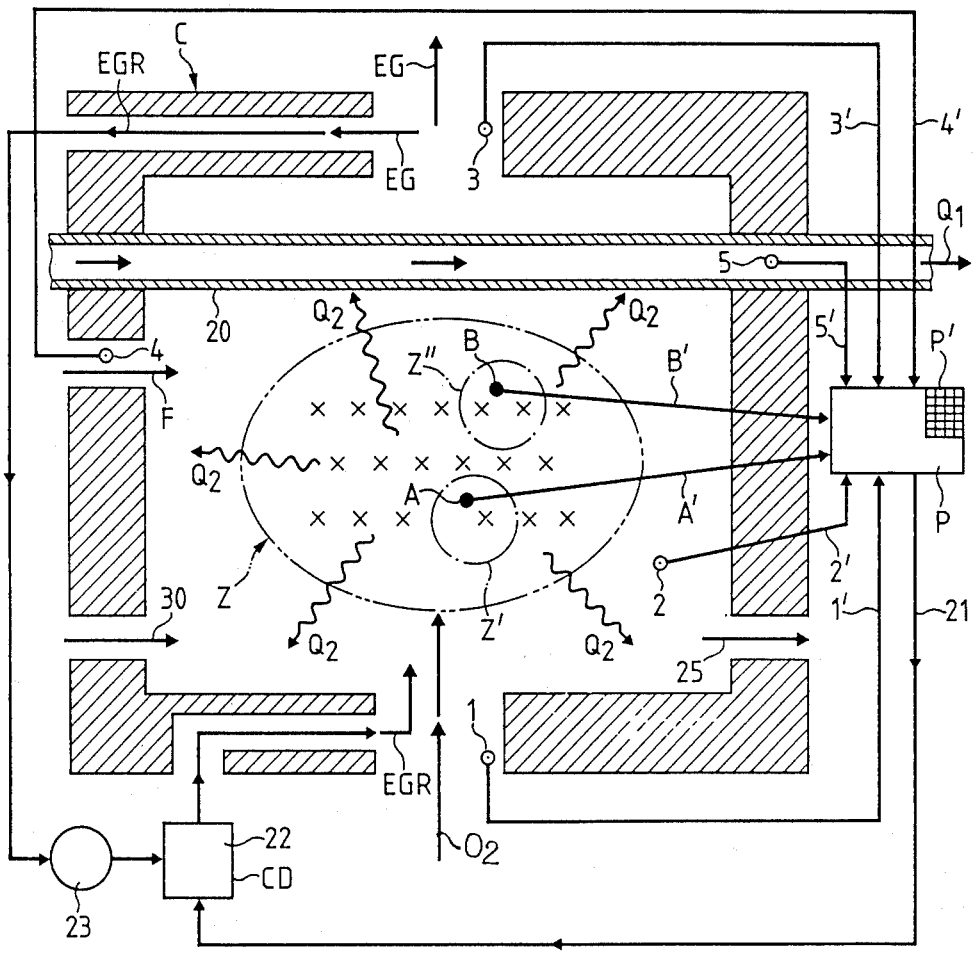

Man made air pollution is a well-known fact. Reducing unnecessary pollution is accepted today to be important. A large amount of air pollution is generated by man made devices for burning fossile energy. Many attempts have been recently made to clean up the exhaust and/or flue gases leaving said devices.

The primary object of the hereinafter described invention is to conduct the combustion process so as to dramatically reduce at least some components of its final residual products, as, for example, partially burnt hydrocarbons and nitrogen oxides. Furthermore, an extraordinarily cheap and hence cost-benefit optimized method of controlling said combustion process is aimed for and described hereinafter.

Although the claims are basically self-explanatory for those skilled in the art, a short description is provided hereinafter in combination with the description of FIG. 1 showing the flow chart of the preferred steps in a schematic manner.

If a predetermined amount of power is demanded for, let us assume X KW, designated by $Q_1$, then, due to efficiency losses, as is well-known, a larger amount of power=X times total efficiency, designated by $Q_2$, must be generated.

In the case of a thermal power generating device, correspondingly combustible material, hereinafter called fuel, must be introduced into a particular zone where combustion takes place. Essentially simultaneously a corresponding amount of oxygen, usually contained in ambient air must also be carried towards said zone. The aforesaid zone quoted Z is usually arranged in a predetermined combustion space wherein combustion hereinafter referred to is to take place.

Up to now, combustion of burnable products or fuel will conform to natural laws whereby an initially smaller rate of heat release, hereinafter call ROHR, is followed upon a time axis by a higher ROHR, and, towards the end of the oxidation process, when already a majority part of the obtainable heat has been released out of a given quantum of burnable components, said ROHR might become smaller than at the time, where only about 60% of heat has been generated.

It has been found by the applicant that a controlled ROHR efficiently contributes to improve combustion and simultaneously dramatically reduces undesired pollution normally generated by conventional combustion processes with exhaust gases being permitted to escape in the usual manner through a stack.

It has also been found by the applicant that the most efficient method to control the ROHR is to recirculate exhaust gases back into the oxygen or oxygen containing air destined for the combustion, hereinafter referred to as EGR for exhaust gas recirculation.

It therefore remains to be determined for a desired ROHR, to measure the effective ROHR and then to control said ROHR in a desired manner, preferably in combination with a closed loop control means.

The measurement of a ROHR is preferably realized by at least one, preferably temperature related, measurement in a first combustion zone quoted A, where combustion, respectively oxidation, takes place. A more efficient method is achievable by measuring a second temperature related value in a second combustion zone quoted B, preferably following said first zone in respect of the heat released already by the oxidizing components. The first and second temperature related values, which will be referred to in greater detail hereinafter, allow for more accurate determination of said ROHR which preferably has to be determined at a given time and at the then prevailing and/or given operating conditions of such thermal power release.

The improved method to be revealed herein has been applied to small scale thermal power generators having a controllable power output between 300 to 1000 KW. The obtained improvements have been:

ca. 50% reduction of the usual losses encountered with state of the art heat generating;
ca. 80% reduction in unburnt hydrocarbons;
ca. 50% reduction in CO emissions;
ca. 60% reduction of $NO_x$ emissions;
reduced control and maintenance costs and
improved cost-benefit-emission ratio.

Further improvements are considered possible by those skilled in the art.

A so-called retrofit onto existing power plants is extremely cheap to achieve.

An apparatus according to the invention is easily produced upon the revealed teaching by those skilled in the art.

The invention will be better understood and further objects and advantages thereof will become more apparent from the ensuing detailed description of a preferred embodiment taken in conjunction with the drawings.

The drawing figure shows a schematic view of one practical construction of my invention and an example of an apparatus to perform at least one of the suggested methods is schematically shown in FIG. 1.

From a study of the drawing it will be seen that ambient air A. is introduced towards an oxidizing zone Z contained in a compartment C and into which fuel F is also introduced. Upon oxidation, in other words combustion, a quantity $Q_2$ of exothermic power is generated. This exothermic power $Q_2$ is then conveyed to any suitable means 20, which may be tubular or not, which is provided to yield a desired amount of heat output $Q_1$ which generally is smaller than the exothermic power $Q_2$.

The end products of the combustion process are exhausted gases EG which are discharged from compartment C, and eventually the ashes, or other residue 25, may be conveniently extracted also from compartment C by means known in the art. The system includes a series of sensor means preferably in at least one first zone, for example, A and/or B, preferably in both zones, these sensors are connected to a control, arranged to receive signals, measurements and the like from predetermined sensors as for instance;

| | |
|---|---|
| an air inlet temperature | sensor 1; |
| a chamber temperature | sensor 2; |
| a flue gas temperature | sensor 3; and |
| a fuel flow related signal | sensor 4 |

as well as a temperature and/or flow measuring sensor 5, which is arranged to sense, for example, the heat output in said means 20.

More particularly, several sensors, designated by 1, 2, 3, 4, 5, TA, TB and eventually others may be connected to a process control means P which actuates upon a control device CD which preferably controls the flow rate of EGR so to essentially obtain coincidence between a targeted ROHR and the effective one.

The system furthermore includes a first zone condition sensor, as for example, a temperature sensor in zone A; a second such or similar sensor arranged in zone B, following zone A in respect to the gaseous flow direction prevailing in the zone Z. All of said aforesaid sensors are connected with said processor P by suitable means drawn schematically and denoted by 1', 2', A', B', 3', 4', 5'. The processor is adapted to control the aimed for coincidence of prevailing (existing) ROHR and a targeted value of the ROHR desired. The control signal being transmitted via connecting means 21 toward a control device 22 designed to control the flow rate of EGR. Furthermore, an auxiliary blower or pump device 23 may be utilized so as to enhance or even generate, if so required, said EGR mass flow, required for efficiently controlling the described and controlled oxidation process.

It is also to be understood that said control of said ROHR is achievable by introducing towards said combustion zone a controllable flowrate of other components such as, lime, chalk and or other desirable material through accordingly arranged introducing and flow control means as shown by arrow 30 in FIG. 1.

Furthermore, the preferable combination of heavy, this means up to over 50% EGR recirculation, together with adequate feeding of other material yields into a most desirable effect to thereby avoid nondesired clogging tendencies of components within and or above said combustion zone.

The foregoing relates to a preferred exemplary embodiment of the invention, it being understood that other variants and embodiments thereof are possible within the spirit and scope of the invention, the latter being defined by the appended claims.

What is claimed and desired to be secured by Letters Patent of the United States is:

1. Method to directly control the rate of heat release hereinafter referred to as ROHR of a combustion process forming a heat source in a heat generation device whereby heat is at least generated substantially by oxidation of fossil combustible products, or biogas, where fuel and oxygen are combined in at least one reaction zone to react exothermally and further wherein said reaction is confined within chamber means including at least an exhaust gas duct for exhaust gas, at least one oxygen containing gas inlet and fuel introduction means, comprising the steps of:

positioning at least on sensor means in said at least one reaction zone for sensing ROHR of said heat generation source in said at least one reaction zone and connecting said at least one sensor means to a comparator, generating at least one target value of a desired ROHR within said comparator, determining said ROHR data of said heat generation in said at least one reaction zone and transmitting said data into said comparator, recirculating at least a portion of said exhaust gas ahead of said at least one reaction zone, providing control means for controlling a flow rate of said exhaust gas for controlling ROHR of said heat generation, and connecting said comparator means with said control means for controlling the rate of exhaust flow, whereby coincidence between said target value and said sensed value of said ROHR is achieved by controlling the rate of said exhaust flow into the at least one reaction zone.

2. Method according to claim 1, wherein said determined ROHR is sensed by sensing at least a temperature related signal in a first zone of said at least one reaction zone where heat is released.

3. Method according to claim 2, wherein said ROHR is determined by at least two sensor means, arranged in succession in said at least one reaction zone, whereby plural data outputs achieve a more accurate determination of said ROHR.

4. Apparatus to generate heat out of combustion of burnable matter, to achieve low emission levels and simultaneously improve total efficiency, including at least one compartment designed to contain at least one combustion zone, air inlet and exhaust gas outlet means, means provided to feed at least fuel and air towards said at least one compartment, igniting means in said at least one combustion zone, exhaust gas recirculating means to feed gases back into said at least one combustion zone and flow control means to control the flow rate of said recirculated exhaust gas, further comprising at least one sensor means positioned in said at least one combustion zone for sensing the rate of heat release (ROHR) of a predetermined quantum of burnable charge, comparator means connected to said at least one sensor means and associated with said apparatus, said comparator means including storage means arranged to store at least one predetermined desired value related to a desired ROHR at a desired operating condition of said apparatus, said comparator further being designed so as to determine an eventual difference between the sensed ROHR and the desired ROHR, said comparator further arranged to transmit signals to said flow control means for controlling a flow rate of said recirculated exhaust gas in such a manner as to establish coincidence between said desired and said sensed ROHR.

5. Apparatus according to claim 4, comprising at least two sensor means connected to said apparatus, to determine at least two values related to said combustion, whereby the determination of said two values provide more accurate determination of said to be determined ROHR of said combustion and hence enabling more accurate control of the flow rate of said recirculated exhaust gas to obtain said desired coincidence.

6. Apparatus according to claim 4, comprising further means arranged to control said ROHR generated by said heat release, i.e., combustion, said means further adapted to control entrance of desirable material such as lime into said combustion zone.

* * * * *